US007828258B2

(12) United States Patent
Shigio et al.

(10) Patent No.: US 7,828,258 B2
(45) Date of Patent: Nov. 9, 2010

(54) PERSONAL ACCESSORY HANGER

(76) Inventors: Linda T. Shigio, 130 Sutro Heights Ave., San Francisco, CA (US) 94121; Thomas H. Grimm, 1031 Barrow La., Napa, CA (US) 94558

( * ) Notice: Subject to any disclaimer, the term of this patent is extended or adjusted under 35 U.S.C. 154(b) by 0 days.

(21) Appl. No.: 12/460,526

(22) Filed: Jul. 20, 2009

(65) Prior Publication Data

US 2010/0025555 A1 Feb. 4, 2010

Related U.S. Application Data

(60) Provisional application No. 61/137,999, filed on Aug. 4, 2008.

(51) Int. Cl.
*F16B 45/00* (2006.01)

(52) U.S. Cl. ..... 248/308; 248/914; 223/120

(58) Field of Classification Search ..... 248/308, 248/304, 301, 914, 339, 341, 307, 690, 691, 248/692; 223/120
See application file for complete search history.

(56) References Cited

U.S. PATENT DOCUMENTS

| | | | | |
|---|---|---|---|---|
| 2,473,086 | A | | 6/1949 | Montero |
| 2,516,760 | A | | 7/1950 | Doran |
| 2,521,037 | A | | 9/1950 | Brinton |
| 2,565,719 | A | | 8/1951 | Church |
| 2,920,369 | A | * | 1/1960 | Zezula ..... 24/490 |
| 3,376,006 | A | * | 4/1968 | Zezula ..... 248/227.2 |
| 3,860,210 | A | | 1/1975 | Berardinelli et al. |
| 4,118,001 | A | | 10/1978 | Serkez |
| 4,194,714 | A | | 3/1980 | Schultz |
| 4,210,302 | A | * | 7/1980 | Serkez ..... 248/308 |
| 5,094,417 | A | | 3/1992 | Creed |
| 6,345,796 | B1 | | 2/2002 | Neuman |
| 2005/0056746 | A1 | | 3/2005 | Landver |
| 2005/0161570 | A1 | | 7/2005 | Bauerly |
| 2006/0214074 | A1 | | 9/2006 | Daoud |
| 2008/0042032 | A1 | | 2/2008 | Yap et al. |
| 2008/0054139 | A1 | | 3/2008 | Fabbri |
| 2008/0083862 | A1 | | 4/2008 | Salatka |

OTHER PUBLICATIONS www.abcnews.go.com/GMA/Health/Story?id=2283311 "Your Purse Could Be Making You Sick", Aug. 8, 2006 Elisabeth Leamy.

* cited by examiner

*Primary Examiner*—Anita M King
(74) *Attorney, Agent, or Firm*—Jon M. Dickinson, Esq.; Robert D. Varitz, Esq.

(57) ABSTRACT

A cantilever, gravity hanger for holding by hanging a personal accessory, operatively attachable to, or integrated with, such an accessory. The hanger, in an operative condition poised for holding such an accessory, includes (a) an elongate central body, (b) a pair of spaced, elongate arms joined to opposite ends of the body, and extending laterally outwardly from a common side of the body in diverging relation to one another, and (c) accessory-connection traveler structure including a traveler carried captively on, and shiftable freely and reversibly along the length of, one of the arms.

11 Claims, 3 Drawing Sheets

PERSONAL ACCESSORY HANGER

CROSS-REFERENCE TO RELATED APPLICATION

This application claims priority to prior-filed, U.S. Provisional Patent Application Ser. No. 61/137,999, filed Aug. 4, 2008, for "Handbag Hanger"—the entire disclosure content of which provisional application is hereby incorporated herein by reference.

BACKGROUND AND SUMMARY OF THE INVENTION

This invention pertains to a portable, quickly deployable, and easily re-stowable, accessory hanger, such as a purse hanger, which may be either an independent device, or a structure integrated with that which it is to be used to hang. For convenience in the balance of this invention disclosure, most discussion about the invention herein will be made in reference to a woman's purse as a representative accessory, with the understanding that this discussion should be understood to refer to accessories other than a purse, such as an umbrella, etc., and, of course, to accessories belonging to men as well as to women.

The problems so conveniently and handily solved by the present invention are familiar to all who carry freely exposed accessories that need to be "stored" temporarily, and readily at hand, in locations such as restaurants, coffee shops, etc. The resolution offered by the invention enables quick and easy hanging of an accessory, in what is referred to herein as a cantilever fashion, on and from the edge of any conveniently available external structure, such as a tabletop or a countertop.

In general terms, the hanger of the invention, in its preferred embodiment, takes the form of a compact, generally flat-planar, linear, tri-fold (two fold-axis) device having an elongate, central body, on the opposite ends of which are pivoted (one on each end) inner ends of two, elongate, swing arms that have folded and stowed, and unfolded and deployed (outwardly diverging), conditions relative to the hanger's central body. The hanger has the mentioned flat-planar configuration when the arms are in their respective folded, stowed conditions.

A sliding-motion, accessory-connection traveler structure having a sliding-motion traveler, and which is part of what is referred to herein as a traveler system, includes an outwardly exposed "connecting portion" which is used in all instances to participate in a direct connection to and with an accessory to be served. The traveler is capturedly, or captively, mounted, and carried for reversible, free, longitudinal sliding motion, on one of the arms. The traveler, in its sliding motion behavior, offers a special and unique, load-bearing-adjustment behavior during use of the hanger of the invention, as will be explained in greater detail later herein. In this context, and in somewhat general terms, the traveler has both hanger-deployed and hanger-non-deployed load-bearing dispositions. The traveler shifts (slides) freely between these two dispositions along the arm which carries it during folding and unfolding of that arm. The hanger-deployed disposition exists with this "carrying" arm residing in its unfolded and deployed condition, and with the traveler then located adjacent that arm's outer, free (non-pivoted) end. The hanger-non-deployed disposition exists with the "carrying" arm occupying its folded and stowed condition, and with the traveler then located adjacent the "carrying" arm's pivoted end.

In the hanger structure of the invention, one of the two arms, under user manipulation and control, swings out to an associated, defined angle (angular extension) relative to the body, thereafter to rest by gravity (as placed by a user during use of the hanger) in a cantilever fashion on the top surface adjacent an edge of an external support structure, such as those just mentioned above. The other arm, also under user manipulation and control, swings out to another, associated, defined angle (another angular extension) relative to the body, and carries with it appropriate connecting structure for (a) pre-established (or subsequently establishable) releasable attachment, or (b) in certain instances, permanent (as in integrated) attachment, to the accessory which is to be served and "hung".

A hung accessory will typically hang immediately below the just-mentioned "other arm", and beneath, and slightly inwardly of, the perimeter of the edge of a user-selected, external supporting structure.

Specially constructed releasable detent structure (detent releasable latching structure), and inter-arm, confronting catch structure, normally cooperate to keep both swing arms releasably stabilized (i.e., restrained) in their folded and stowed conditions when the hanger is not in use holding an accessory.

These and various other novel and useful features and advantages of the hanger of the invention will become more fully apparent as the descriptions presented below of preferred and best-mode embodiments of it are described in conjunction with the accompanying drawings.

DESCRIPTIONS OF THE DRAWINGS

FIG. 1 presents an isometric view of one preferred and best-mode embodiment of a hanger constructed in accordance with the present invention. This hanger is illustrated herein with its two swing arms in respective, folded and stowed conditions, and with the hanger thus pictured in a non-deployed, compact, flat-planar configuration.

FIG. 2 is an isometric view prepared on about the same scale as that which is employed in FIG. 1, illustrating the hanger of FIG. 1 in an unfolded and deployed condition ready for use, with a pair of included, pivoted swing arms pictured in unfolded and laterally outwardly extending, angularly diverging conditions relative to a central body in the hanger. In solid, and dash-double-dot, lines in this figure, a traveler in the hanger is shown in two, different "moved-to" positions relative to one of the swing arms in the hanger.

FIG. 3 is a fragmentary and larger-scale, "divided-function (left side, right side)" drawing illustrating portions of each of the two opposite ends of the hanger pictured in FIGS. 1 and 2 where pivot connections exist between the hanger's central body and its two, pivoted swing arms. This figure specifically shows details of structures which are employed, with respect individually to each of the two swing arms, differently to limit the respective ranges of angular swinging deployments which are enabled for these arms. The left side of FIG. 3 is essentially a vertically inverted view looking at the upper, right corner of the facing side of the hanger as shown in FIG. 1. The right side of FIG. 3 is essentially a laterally rotated (around an upright axis) view looking at the rear side of the lower left corner of the hanger as shown in FIG. 1.

FIG. 4 is a side elevation illustrating the hanger which has been discussed so far in relation to the three, above drawing-figure descriptions in substantially the same, unfolded and deployed condition which is pictured for it in FIG. 2. More specifically, the illustrated hanger is shown here in a condition wherein it is cantilever gravity supporting a detachably attached personal accessory in the form of a purse, portions of which are shown only fragmentarily. FIG. 4 is drawn on a scale which is slightly smaller than the scale employed in FIGS. 1 and 2.

FIG. 5 is a simplified, isometric, vertically exploded, and isolated view of components which are present in one of the swing arms included in the hanger illustrated in the several other drawing figures mentioned so far. FIG. 5 is drawn on a scale which is slightly larger than that employed in FIGS. 1 and 2.

FIG. 6, which is drawn on about the same scale as that which is used in FIG. 3, is a fragmentary, side cross section taken generally along the line 6-6 in FIG. 3, further illustrating, inter alia, the arm and its components that are shown in the exploded view of FIG. 5. FIG. 6 also illustrates, through certain, moved-position presentations, the operations both of a detent releasable latching structure, and of a confronting catch structure, which are employed in the hanger of the invention.

FIG. 7 is a simplified, isometric view of a woman's purse including a handle to which the hanger illustrated in FIGS. 1-6, inclusive, has been detachably attached. Previously mentioned FIG. 4 in the drawings is related to FIG. 7, in that FIG. 4 pictures (in a fragmentarily way) a situation with the illustrated hanger gravity cantilever hanging and supporting the purse of FIG. 7 on the edge of a tabletop.

FIG. 8 illustrates, in two, moved-position views, a modified form of the hanger of the present invention "permanently" attached to an interior strap that is included as part of the internal structure of a woman's purse. The purse here is illustrated in solid lines in a condition with the hanger contained concealed within it (see the dashed-line outline of the hanger in a non-deployed configuration). In dash-double-dot lines, the hanger in this figure has been withdrawn from the inside of the purse, deployed, and placed in a condition hanging and supporting the purse on a suitable (but not specifically illustrated) external structure, such as a tabletop.

DETAILED DESCRIPTION OF THE INVENTION

Figure 1:
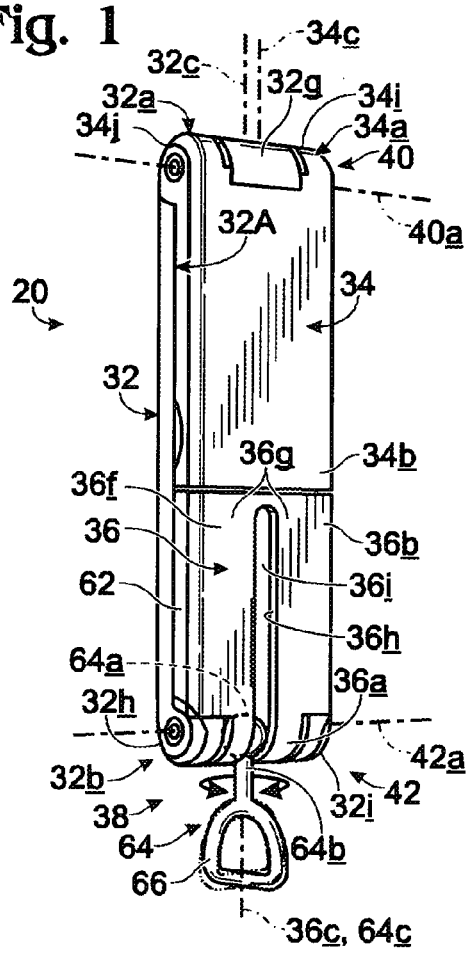
Figure 6:
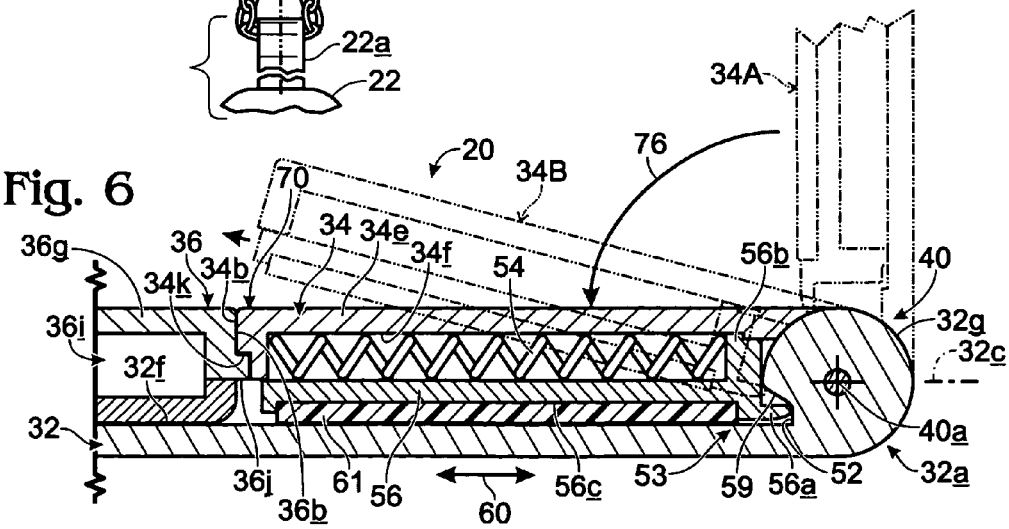
Figure 7:
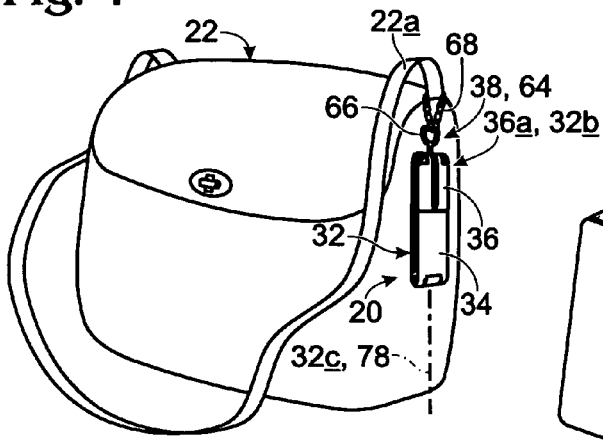
Figure 8:
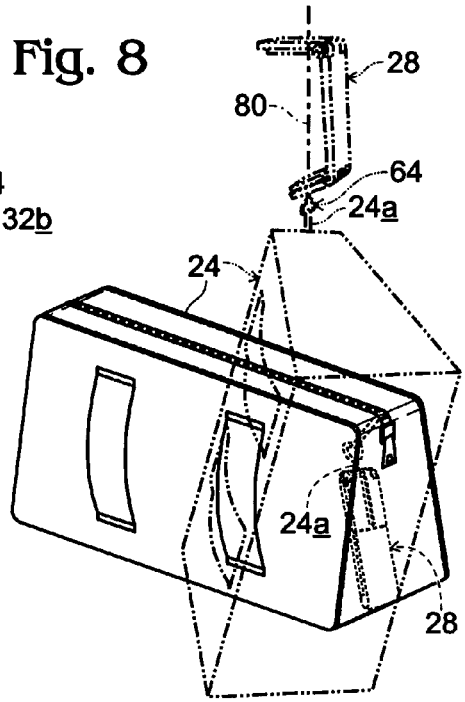
Figure 9:
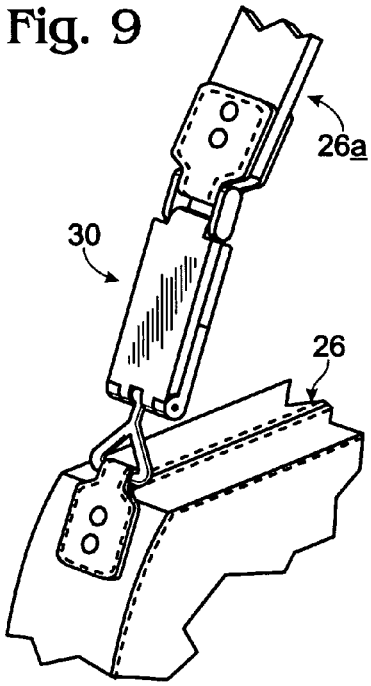
FIG. 9 is a relatively large-scale, fragmentary, isometric view of yet another embodiment of the hanger of the present invention which, in this case, is integrated into one end of the exposed handle of a woman's purse.
Figure 10:
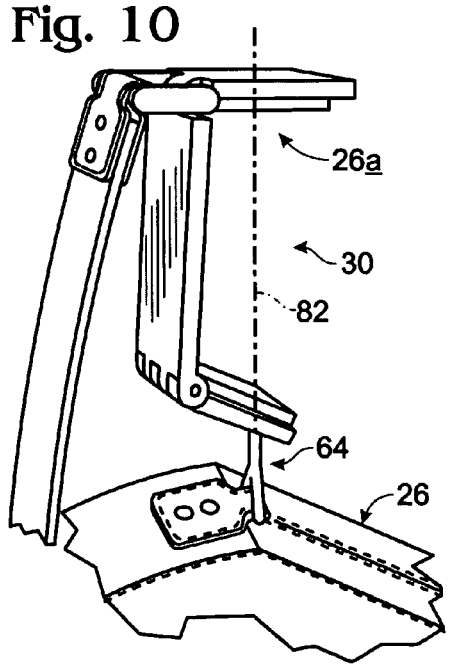
FIG. 10 is a fragmentary, isometric view, on about the same scale as that which is employed in FIG. 9, illustrating the hanger of FIG. 9 deployed for use and hanging the illustrated purse on an appropriate, but not pictured, external structure, such as a tabletop.

Turning now to the drawings, and referring to all of the drawing figures, shown generally at 20 is a preferred and best-mode embodiment of a hanger for a personal accessory, such as a purse, like the purses shown at 22, 24, 26 in FIGS. 1 and 7 (purse 22), FIG. 8 (purse 24), FIGS. 9 and 10 (purse 26). Hanger 20, which is also referred to herein as a foldable/deployable, cantilever, gravity hanger, is usable, as will become apparent, with a large variety of personal accessories, such as purses, umbrellas, shoulder bags, shopping bags, and, of course, indiscriminately, both female and male accessories. As will be seen, the hanger of this invention, in an appropriate, different one of its three, herein illustrated and described embodiments, 20 (FIGS. 1-7, inclusive), 28 (FIG. 8), 30 (FIGS. 9 and 10), may either be an "attachable" (i.e., selectively attachable) device (embodiment 20), or an integrated, more permanently "attached" (including integrated) device (embodiments 28, 30). Conveniently, the hanger of the invention folds when not in use as a hanger, to a generally flat-planar form, as mentioned earlier herein, and as can clearly be seen in FIGS. 1 and 7 (in solid lines), FIG. 8 (in dashed lines), and FIG. 9 (in solid lines).

In each of these three hanger embodiments, the main structural components therein, and their interrelated, cooperative organizations and relationships, are essentially the same. Accordingly, the detailed component descriptions herein relevant to all three of these embodiments will be given only with specific reference to hanger 20.

Hanger 20 includes (a) an elongate central body 32, having opposite ends 32*a*, 32*b*, and a long axis 32*c*, (b) two, elongate swing arms 34, 36, having opposite ends 34*a*, 34*b* and 36*a*, 36*b*, respectively, and long axes 34*c*, 36*c*, respectively, and (c) what is referred to herein as a traveler system, shown generally at 38, mounted on and associated with swing arm 36. Arm ends 34*a*, 34*b* are referred to herein as the arms' "one" ends. Arm ends 34*b*, 36*b* are referred to herein as the arms' "free" ends.

In relation to the swingable nature of arms 34, 36 relative to body 32, swing arms 34, 36 have what are referred to herein as (1) folded, stowed and (2) unfolded, deployed conditions relative to central body 32. The arms are shown in their respective folded, stowed conditions in FIGS. 1 and 7, and in their respective unfolded, deployed conditions in FIGS. 2 and 4.

In their folded, stowed conditions, arms 34, 36 lie substantially longitudinally coextensively (respecting one another), and in a generally common plane which contains their respective long axes, 34*c*, 36*c*, along and immediately adjacent what is referred to herein as a common side 32A in central body 32. In this condition, and as can be seen especially well in FIG. 1, the arms' long axes substantially parallel the long axis, 32*c*, of body 32.

Figure 2:
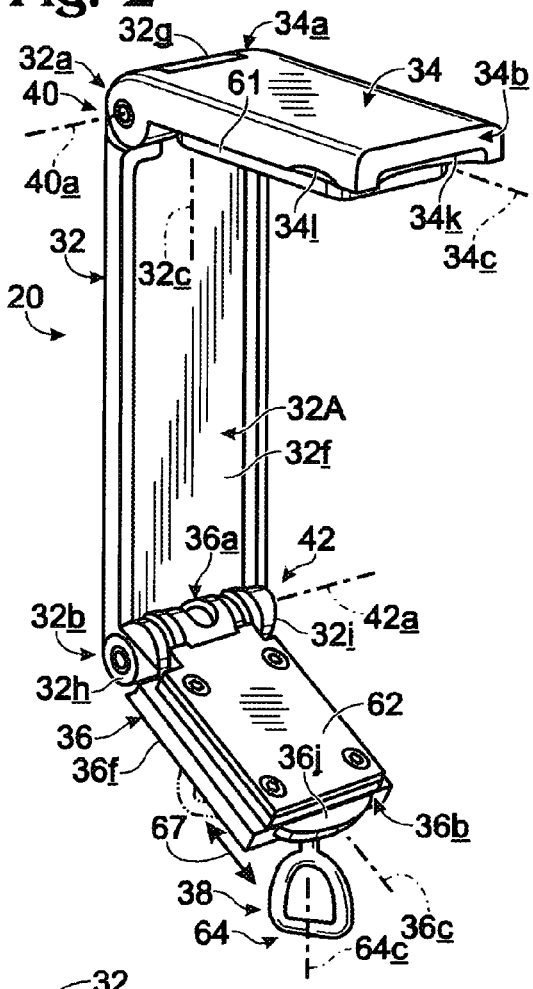
Figure 4:
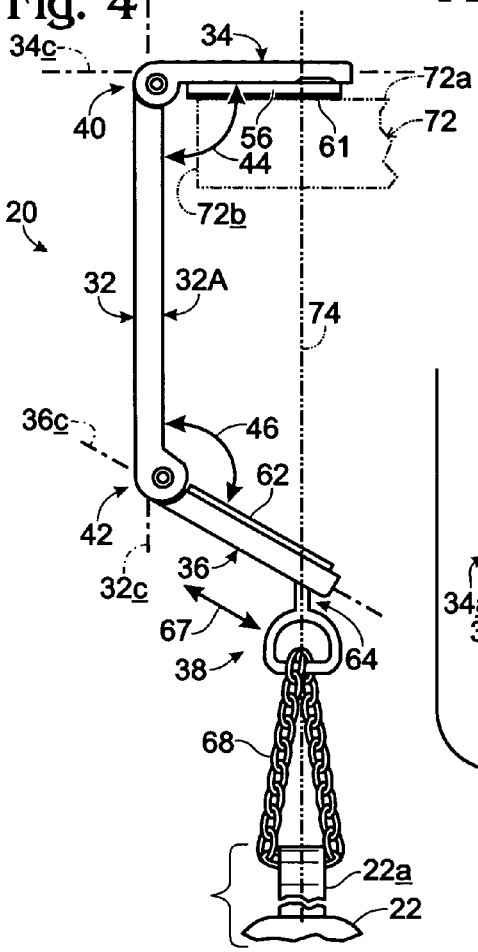

In their unfolded, deployed conditions, the arms extend laterally outwardly from central-body common side 32A in a manner diverging angularly outwardly from the central body, as can be seen clearly in FIGS. 2 and 4. This outward divergence is referred to herein as a diverging relation between the two swing arms.

Swing arms 34, 36, at their respective ends 34*a*, 36*a*, are pivoted through pivot connections 40, 42, respectively, to ends 32*a*, 32*b*, respectively, in central body 32. Pivot connections 40, 42 furnish pivot, or swing, axes 40*a*, 42*a*, respectively, to accommodate and define (at least partially), for arms 34, 36, respectively, swing arcs 44, 46, respectively (see particularly FIG. 4). Further participating in defining these two swing arcs, as will be more fully described and discussed, are appropriate, pivot-connection-associated, swing-arc limit structures, such as the two limit structures illustrated generally at 48, 50 in the single, fragmentary, "dual" (or divided-function), pivot-connection detail view presented in FIG. 3, which figure also illustrates relevant, fragmentary portions of both pivot connections, 40, 42. Limit structures 48, 50 are also referred to herein as swing-arc unfolding limit structures.

Figure 3:
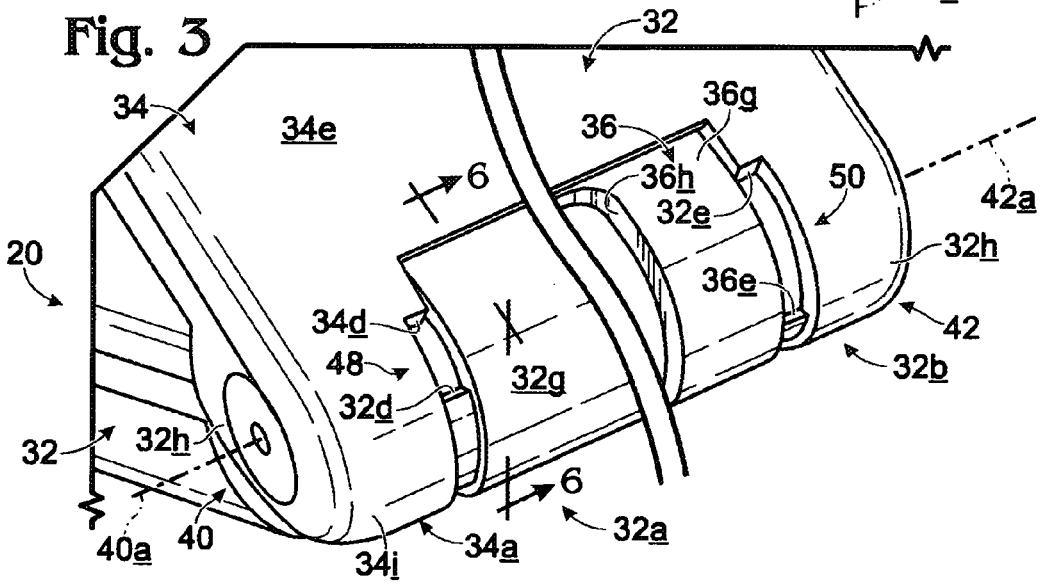

From what is pictured in FIG. 3, coupled with the description of this drawing figure which now follows, those skilled in the art will readily understand how to create these two swing-arc-limit structures as illustrated, and will also appreciate the fact that other, specific swing-art-limiting structural approaches may be employed in the hanger of the invention, if desired.

As was just mentioned, divided-function FIG. 3 (laterally divided) is used herein to show the two, respective, swing-arc limit structures that are furnished in relation to pivot connections 40, 42 to limit the angular extents of swing arcs 44, 46, respectively, for swing arms 34, 36, respectively. Accordingly, appropriately formed in hanger body 32, and in arm components 34, 36, in relation to pivot connections 40, 42, are pairs of "operatively confronting", contact-engageable, swing-interference shoulders 32*d*, 34*d* and 32*e*, 36*e*, respectively. Engagement of shoulders 32*d*, 34*d* limits swing arc 44 herein to substantially 90°. Engagement of shoulders 32*e*, 36*e* limits swing arc 46 herein to substantially 120°. Other angular swing limits, in another range (different than the range herein of about 90° to about 120°), may be chosen if desired, but these two, specific, angular-range limit choices have been proven to be very satisfactory, and preferred.

Continuing with descriptions of specific hanger components, central body 32 is preferably an appropriately formed metallic component having the configuration illustrated clearly in FIG. 2. Common side 32A is formed with a shallow, generally rectangular well 32*f* which freely receives those portions of arms 34, 36 which directly face side 32A when the arms are in their folded, stowed conditions, as in FIGS. 1 and 7.

Opposite end enlargements, such as enlargement 32*g* (adjacent central-body end 32*a*), which are disposed laterally centrally in body 32, and enlargements 32*h*, 32*i* (which are disposed in laterally spaced locations adjacent the opposite lateral sides of central-body end 32*b*), form readily evident portions of previously mentioned pivot connections 40, 42, respectively.

Furnished in central body 32, in its end enlargement 32*g*, and at the location shown at 52 in FIG. 6, is an elongate, laterally extending channel which is disposed with its long axis (not specifically indicated) lying generally orthogonally relative to central body axis 32*c*. Channel 52 forms part of what is referred to herein as detent releasable latching structure 53 which operates, as will shortly be more fully explained, in relation to folding and unfolding (swinging) of swing arm 34 relative to central body 32. This detent structure helps to hold arm 34 in its folded, stowed condition under circumstances when hanger 20 is not being employed to hang and hold an accessory (see FIGS. 1 and 6).

Figure 5:
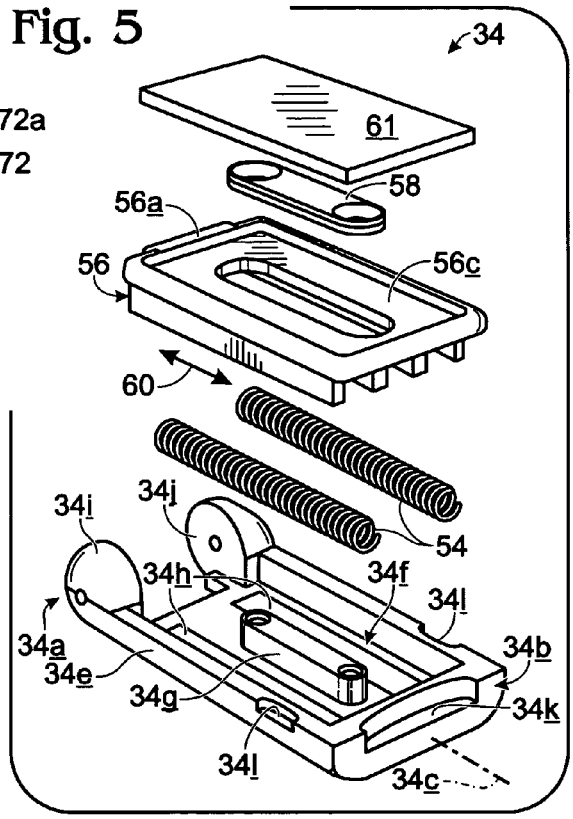

Directing attention now especially to the exploded view of FIG. 5, arm 34 includes, preferably, a suitably formed main component 34*e* possessing a shallow well 34*f* featuring a centered, elongate, projecting island 34*g* which, along with well 34*f*, defines a pair of spaced, elongate, generally parallel channels 34*h*. Channels 34*h* freely receive (one each) two detent compression biasing springs 54. Two, laterally spaced end enlargements 34*i*, 34*j* (see also the left side of FIG. 3) formed in main arm component 34*e* adjacent arm end 34*a* form part of previously mentioned pivot connection 40.

Further provided in swing arm 34 is an elongate, slidable detent plate 56 having the configuration clearly seen in FIGS. 5 and 6. Adjacent one of its ends (the far end in FIG. 5, and the right end in FIG. 6), plate 56 includes an elongate, laterally extending rib 56*a*. Plate 56 is appropriately captured slidably within well 34*f* by a screw-attached (screws not shown), central retainer 58 which is anchored to central island 34*g*. Rib 56*a* as can be seen, is disposed toward pivot-connection enlargements 34*i*, 34*j*, and is designed for releasable, spring-biased, detent "capture" in previously mentioned channel 52 provided in central body enlargement 32*g*.

Focusing for a moment specifically on the right side of FIG. 6, rib 56*a* is axially, transversely shaped (in cross section as viewed along its long axis, which is not marked) to function as a cam follower during swinging of arm 34 about pivot axis 40*a*, and in relation to an inclined, associated, contacting cam surface 59 that extends, in parallel, and is formed transversely on and across previously mentioned central body enlargement 32*g*. This camming action is associated with operation of earlier mentioned detent latching structure 53, and will be discussed more fully later herein.

Plate 56 and retainer 58 are appropriately co-dimensioned to accommodate a required, limited amount of reversible, axial sliding (see double-headed arrow 60 in FIGS. 5 and 6) of plate 56 along arm axis 34*c* within well 34*f*. The plate is biased toward pivoted arm end 34*a* by biasing springs 54 which act in compression between the end of arm component 34*e* (which effectively defines arm end 34*b*), and appropriate spring-engaging structure 56*b* which is provided adjacent the "far" end of plate 56 in FIG. 5 (see the right end of the plate in FIG. 6).

A suitable-material frictioning pad 61 overlies plate 56 in arm 34 as shown, and is held in place, in a very shallow well 56*c* in the plate, by an appropriate adhesive.

As can be seen particularly in FIGS. 2, 5 and 6, located adjacent arm end 34*b* in arm main component 34*e*, a small, curved-wall shelf 34*k* is formed. This shelf functions, as will soon be explained, as a part of the previously mentioned confronting catch structure whereby arm 34, in its folded, stowed condition, releasably holds arm 36 in its folded, stowed condition.

Finally with regard to arm 34, provided, and exposed functionally, on laterally opposite sides of main arm component 34*e*, near arm end 34*b* as can be seen, are (one on each side) shallow, finger-engageable indents 34*l*. These indents facilitate initial finger-engaging of arm 34 when it is in its folded, stowed condition to enable swinging of the arm, against releasable, latching-detent-resistance, outwardly toward its unfolded, deployed condition—an action which also frees arm 36 for swinging outwardly toward its unfolded, deployed condition.

Turning now to FIGS. 1-3, inclusive, and 6, swing arm 36 includes a bifurcated main component 36*f* having laterally spaced fingers 36*g* defining an elongate slot 36*h* which opens to opposite sides, or faces, of the main component. Slot 36*h*, referred to herein as a travel slot, forms part of previously mentioned traveler system 38. The free ends of fingers 36*g* (the lower ends of these fingers as seen in FIG. 1) form part of previously mentioned pivot connection 42.

As an aside, appropriate pivot pins (not specifically marked herein) engage the several pivot-connection components described above to define previously mentioned pivot axes 40*a*, 42*a*.

Continuing with descriptions of structural componentry included in and associated with swing arm 36, a plate 62 is secured appropriately to the inner side, or face, of arm main component 36*f* to define a compartment 36*i* (see FIGS. 1 and 6) which captures the enlarged, generally spherical, inner end 64*a* of a traveler 64 having a stem portion 64*b*, referred to herein as a sliding-motion portion, which extends from compartment 36*i* outwardly through slot 36*h* to the outer side of component 36*f*, there to join with an included, outwardly exposed catch loop 66. Traveler 64 includes a long axis 64*c* (seen in FIGS. 1 and 2) about which it can freely rotate to accommodate convenient attachment of loop 66 to, and use with, an accessory in a manner avoiding any "attachment-twist/kink" condition. For example, in dash-double-dot lines in FIG. 1, the traveler and its loop are shown rotated by about 90° in relation to their solid-line illustrations in this figure.

Traveler 64 and loop 66 collectively form what is called herein accessory-connection traveler structure which is freely slidable reversibly (see double-headed arrow 67 in FIGS. 2 and 4) along the length of slot 36*h*, essentially between ends 36*a*, 36*b* in arm 36, substantially in parallel with arm axis 36*c*.

This sliding-traveler construction in the hanger of the present invention is an extremely useful load-bearing and convenience feature therein, as will shortly be explained.

With regard to hanger 20, loop 66 is usable for releasable/detachable attachment of the hanger, as via a chain like that shown at 68 in FIGS. 4 and 7, to a purse, such as purse 22.

Looking now for a moment particularly at FIGS. 2 and 6, within arm 36, the outer end surface of arm main component 36*f*, adjacent free end 36*b*, is shaped with a projecting tab structure 36*j* which is complementary to, and functionally overlapable with, previously described shelf 34*k* in arm 34 to furnish the balance of the earlier touched-upon confronting catch structure—shown collectively, and generally, at 70 in FIG. 6. Catch structure 70 functions, with the two swing arms in their respective folded, stowed conditions, in a manner whereby arm 34 holds arm 36 releasably in its folded, stowed condition. Arm 34 is held releasably in its folded, stowed condition by earlier described detent releasable latching structure 53.

With attention directed now especially toward FIG. 6, this drawing figure is useful for illustrating a description and explanation of the cooperative operations of the detent releasable latching structure, of the confronting catch structure, and of associated other structures in hanger 20. We will begin a discussion of the operations, inter alia, of the two, "cooperative mechanisms" under the assumption that the starting point for description involves the condition with hanger 20, as seen, for example, in FIG. 2, in a fully deployed status, that is, with arms 34, 36 outwardly and fully extended angularly from central body 32. In this condition of the hanger, detent-plate rib 56*a* in swing arm 34 is engaged, under compression urging of detent plate 56 by detent springs 54, with the outer, curved surface of end enlargement 32*g* in central body component 32. The fragmentary, dash-double-dot outline of several components (including plate 56 and rib 56*a*) in arm 34 provided at 34A (adjacent the right side of FIG. 6) illustrates this condition, with respect to which condition, one can readily see the then-existing positional status of detent plate 56 relative to other components in arm 34.

In this deployed condition of things, wherein both swing arms are fully unfolded, and outwardly extended and deployed, neither of the two, subject, cooperative mechanisms whose operations are now being explored are engaged in any cooperative behavior.

When it is time to fold the two swing arms to their stowed conditions, swing arm 36 is first swung inwardly to its stowed condition, shown fragmentarily in solid lines adjacent the left side of FIG. 6, and is suitably held in place in that condition in an appropriate, temporary manner. Tab structure 36*j* in arm 36 is then positioned as illustrated.

Swing arm 34 is then swung toward its folded and stowed condition as is indicated generally by arrow 76 in FIG. 6. As arm 34 comes close to its folded and stowed condition, and here see the dash-double-dot outline of this arm (and several of its components) marked at 34B in FIG. 6, shelf 34*k* and projecting tab structure 36*j* provided in arms 34, 36, respectively, approach one another, ultimately to come into confrontational contact in a manner whereby the shelf in arm 34 effectively releasably prevents outward swinging of arm 36 away from its folded and stowed condition. This condition is pictured in solid lines in FIG. 6.

Simultaneously, rib 56*a*, under the influence of biasing springs 54, and just when the rib, through continued inward swinging of arm 34 relative to central body 32, reaches the position shown for it in dash-double-dot outline 34B, is ultimately and quickly (in a "snap-action" fashion) spring-driven into channel 52 in end enlargement 32*g* to create then a reversible, releasable detent latching condition in which arm 34 is detent-held in its folded and stowed condition. This condition is also illustrated in solid lines in FIG. 6.

From the undeployed, folded and stowed conditions of arms 34, 36, when it is desired to deploy the hanger for use, the user simply finger-engages one or both of the described, finger-engageable indents 34*l* easily and quickly to lift and swing arm 34 out of its detent-latched status, and outwardly away from central body 32. This action, of course, frees arm 36 for unfolding and outward deployment.

Continuing with description of the invention, and focusing now on FIG. 7 in the drawings, this figure illustrates hanger 20 in a situation detachably attached through chain 68, loop 66, and traveler 64 in traveler system 38 to the handle 22*a* in purse 22. Hanger 20 is shown in a condition with arms 34, 36 disposed in their respective folded, stowed conditions, with the traveler in the traveler system located, naturally by gravity, adjacent pivoted end 36*a* in arm 36, which end, as illustrated in this figure, is the upper end of this arm—immediately adjacent the likewise upper end 32*b* in central body 32. This load-bearing disposition for traveler 64 is referred to herein as a hanger-non-deployed load-bearing disposition for the traveler.

It will be apparent that this condition for hanger 20 and traveler 64 is one which develops naturally in the situation illustrated in FIG. 7. Interestingly, it is a condition which causes "hanger-device" suspension load through the traveler—a gravity load which is developed by the hanger, per se, through its loop 66—to be handled essentially along the long, and now substantially vertical, axis 32*c* in central body 32 which effectively lies along (i.e., is coincident with) a gravity line 78. This is clearly not only a naturally arrived-at condition, promoted by the traveler system, but one which is ideally and best suited for a disposition of hanger 20 under circumstances when it is attached to, but not yet specifically in use holding (for hanging) purse 22.

FIG. 4 in the drawings illustrates hanger 20 in a condition with arms 34, 36 unfolded and deployed into their operative "accessory-hanging (load-bearing)" conditions, and specifically, as pictured, with upper arm 34 now resting through anti-slip friction pad 61 on the top surface 72*a*, near the edge 72*b*, of a support structure, such as the fragment of a table shown in dash-double-dot lines at 72 in this drawing figure.

Importantly, with outward angular swinging and deployment of the swing arms in hanger 20, such deployment being effected by detent unlatching of arm 34, as explained, which releases arm 36 for free swinging to its deployed condition, the two swing arms extend, as illustrated, outwardly from common side 32A in hanger central body 32 in the evident, previously mentioned, diverging fashion. Specifically the swing arms deploy and extend in a fashion whereby gravity, and sliding of the traveler in the traveler system along slot 36*h* in arm 36, causes the traveler naturally to shift downwardly, as indicated by the downward direction of arrow 67, to adjacent the outer, free end of swing arm 36, thereby to become positioned as seen in FIG. 4. This load-bearing (accessory-hanging and supporting) disposition for traveler 64 is referred to herein as a hanger-deployed load-bearing disposition for the traveler.

It is thus the case that operation of the traveler system automatically positions the traveler, and included and associated loop 66, for hanging an accessory, such as purse 22, as seen in FIG. 4, in a stable and convenient manner, whereby gravity cantilever hanging of the accessory results in load-bearing taking place along a gravity line 74 which passes through the outer, free end of swing arm 36, and directly overhead through the overlying, external support structure, such as table 72, its edge 72*b* and its top surface 72*a*. Obviously, and as just mentioned, this is an extremely stable and easily achieved hanging condition for an accessory, like purse 22. As is also true in relation to the condition described above of the hanger being in a non-deployed status, with the hanger now in an unfolded and deployed status, the traveler system has automatically adjusted the shiftable traveler to assure that load delivery and bearing through and into the hanger takes place along a gravity line best suited for, in this case, accessory-hanging activity.

FIG. 8 in the drawings illustrates hanger 28 in a condition essentially permanently attached to (integrated with) an internal strap 24*a* in purse 24 in a manner whereby, when this hanger is not in use, it may be stored conveniently inside the interior of the purse (see the dashed-line outline of the hanger), and then easily pulled out (see the dash-double-dot outline of the hanger in FIG. 8) for purse-hanging purposes when desired. Such a purse-hanging condition (absent a specific illustration of the obviously present, overhead, external supporting structure) is fully illustrated in dash-double-dot lines in FIG. 8. In this figure, purse 24 (in dash-double-dot lines) hangs along a gravity line 80.

FIGS. 9 and 10, picturing previously mentioned, modified hanger embodiment 30, show another form of hanger integration into an accessory, such as the illustrated direct integration of hanger 30 into, and adjacent one end of, the handle 26*a* in previously mentioned purse 26. There are, of course, many manners in which the hanger of the present invention may be so integrated directly in the handle of an accessory, and what is illustrated in FIGS. 9 and 10 should therefore simply be taken as a representative showing of this form of integration.

With handle integration occurring as illustrated, specifically near the end of a handle, such as purse handle 26*a* (as seen in FIGS. 9 and 10), deployment and use of the hanger to hang and support an accessory, such as purse 26, is as illustrated in FIG. 10. As in FIG. 8, FIG. 10 omits showing the obvious presence of an overhead supporting structure. In FIG. 10, purse 26 is pictured hanging along a gravity line 82.

Accordingly, a unique gravity, cantilever, deployable/foldable hanger for a personal accessory, such as the accessories mentioned above herein, has been disclosed and illustrated herein in several preferred and best-mode embodiments. The basic structural features of the proposed hanger are essentially the same in each embodiment.

The hanger of the invention, when not in use, folds to a very compact, convenient, and generally flat-planar form, with its swing arms essentially releasably restrained in folded/stowed conditions through the mentioned detent latching structure provided in the hanger, and the swing-arm, end-overlap confronting catch structure whereby the arm which is specifically detent-latched is employed to hold the other swing arm in its, respective, folded, stowed condition.

A unique and highly convenient and functional traveler system is employed to establish direct connection ultimately with a personal accessory regarding which the hanger of the invention is to be used. Uniquely, this traveler system includes a position-shiftable traveler associated with one of the swing arms in the hanger, which traveler adjusts automatically, and slidably, by gravity positioning itself (depending upon hanger status) so that load delivered into and through the hanger is a most appropriately directed along a gravity line for the particular condition in which the hanger, at a given moment in time, is situated. Lateral, outward, angular divergence of the two swing arms in the proposed foldable-style hanger structure, when those arms are deployed for accessory-hanging use, contributes specially to the unique operation of the traveler system during an accessory-hanging situation.

Accordingly, while preferred and best-mode embodiments of the hanger of the present invention have been illustrated and described herein, with certain variations mentioned/suggested, we appreciate that other variations and modifications may be made without departing from the spirit of the invention.

We claim:

1. A foldable, cantilever, gravity hanger for a personal accessory, operatively attachable to, or integrated with, such an accessory comprising an elongate central body, a pair of spaced, elongate swing arms pivoted to opposite ends of said body having unfolded, deployed conditions wherein they extend laterally outwardly from a common side of the body in diverging relation to one another, and accessory-connection traveler structure including a traveler carried captively on, and shiftable freely and reversibly along the length of, one of said swing arms.

2. The hanger of claim 1 which is designed specifically for use with an accessory having a handle, and the hanger is integrated with the handle through said body and said traveler structure.

3. The hanger of claim 2, wherein the accessory is a purse.

4. A foldable/deployable, cantilever, gravity hanger for a personal accessory, operatively attachable to, or integrated with, such an accessory comprising an elongate, central body having a long axis, a common side, and spaced, opposite ends, an elongate swing arm for each of said ends, each also having a long axis and spaced, opposite ends, and each including one end pivotally connected to a different one of said body ends, with the arm being swingable in an arc relative to, and toward and away from, said common side between (a) a folded, stowed condition lying with its long axis substantially paralleling the body's long axis along and adjacent said common side, and (b) an unfolded, deployed condition with the arm extending outwardly from said common side in a condition with its long axis disposed at an angle in a range limited from about 90° to about 120° relative to said body's said long axis, and accessory-connection traveler structure including a traveler carried captively on, and shiftable freely and reversibly along the length of, one of said swing arms.

5. The hanger of claim 4, wherein said one swing arm has a free and which is opposite its said one end, and said traveler has both (a) hanger-deployed and (b) hanger-non-deployed load-bearing dispositions, between which dispositions the traveler travels along said one arm during folding and unfolding of that arm, said hanger-deployed disposition existing with the one arm being in its unfolded condition and with the traveler then located adjacent said one arm's said free end, and said hanger-non-deployed disposition existing with the one arm being in its folded condition and with the traveler then located adjacent said one arm's said one end.

6. The hanger of claim 4 which further comprises, for each arm, swing-arc unfolding limit structure operatively associated with the arm and said body, said limit structure for said one swing arm defining a swing-arc limit of more than 90°, and the limit structure for the other arm defining a swing-arc limit of substantially 90°.

7. The hanger of claim 6, wherein said traveler includes a sliding-motion portion extending outwardly from a side in said one arm, and said traveler structure forms part of a traveler system which further includes an elongate travel slot formed in said side in said one arm from which slot said sliding motion portion extends.

8. The hanger of claim 4 which is designed specifically for use with an accessory having an elongate handle possessing opposite ends, and the hanger is integrated in, and, forms one end of, the handle.

9. The hanger of claim 8, wherein the accessory is a purse.

10. The hanger of claim 4, which further comprises detent releasable latching structure operatively interposed said body and the swing arm which is other than said one swing arm, located effectively adjacent the pivot connection existing between said body and said other arm, and operable to latch said other arm releasably in its said folded, stowed condition relative to said body.

11. The hanger of claim 10, wherein said swing arms have free ends that are equipped with cooperative, operatively confronting catch structure constructed in a manner whereby said other arm, when in its said folded, stowed condition, holds said one arm in its said folded, stowed condition.

* * * * *

UNITED STATES PATENT AND TRADEMARK OFFICE

CERTIFICATE OF CORRECTION

PATENT NO. : 7,828,258 B2
APPLICATION NO. : 12/460526
DATED : November 9, 2010
INVENTOR(S) : Linda T. Shigio It is certified that error appears in the above-identified patent and that said Letters Patent is hereby corrected as shown below:

In column 10, line 46, “free and” should be -- free end --.

Signed and Sealed this
Twenty-fifth Day of January, 2011

David J. Kappos

David J. Kappos
*Director of the United States Patent and Trademark Office*